US008094107B2

(12) United States Patent
Nishimura et al.

(10) Patent No.: US 8,094,107 B2
(45) Date of Patent: Jan. 10, 2012

(54) LIQUID CRYSTAL DISPLAY APPARATUS CONTAINING DRIVER IC WITH GRAYSCALE VOLTAGE GENERATING CIRCUIT

(75) Inventors: Kouichi Nishimura, Kanagawa (JP); Takanori Sumiya, Kanagawa (JP); Hideki Akahori, Kanagawa (JP)

(73) Assignee: Renesas Electronics Corporation, Kawasaki-shi, Kanagawa (JP)

( * ) Notice: Subject to any disclaimer, the term of this patent is extended or adjusted under 35 U.S.C. 154(b) by 1092 days.

(21) Appl. No.: 11/785,756

(22) Filed: Apr. 19, 2007

(65) Prior Publication Data

US 2007/0247409 A1 Oct. 25, 2007

(30) Foreign Application Priority Data

Apr. 20, 2006 (JP) ..... 2006-116275

(51) Int. Cl.
*G09G 3/36* (2006.01)

(52) U.S. Cl. ..... 345/89; 345/690

(58) Field of Classification Search ..... 345/98–100, 345/103, 204

See application file for complete search history.

(56) References Cited

U.S. PATENT DOCUMENTS

| | | | | |
|---|---|---|---|---|
| 4,063,234 | A * | 12/1977 | Arn et al. | 345/73 |
| 5,598,180 | A * | 1/1997 | Suzuki et al. | 345/100 |
| 6,529,180 | B1 * | 3/2003 | Ito et al. | 345/89 |
| 7,030,869 | B2 | 4/2006 | Morita | |
| 7,176,910 | B2 * | 2/2007 | Tsuchi | 345/204 |
| 7,348,954 | B2 * | 3/2008 | Miwa et al. | 345/98 |
| 7,358,946 | B2 | 4/2008 | Kokubun et al. | |
| 7,362,296 | B2 * | 4/2008 | Song et al. | 345/89 |
| 7,499,025 | B2 * | 3/2009 | Endo et al. | 345/157 |
| 7,643,002 | B2 * | 1/2010 | Kang et al. | 345/100 |
| 2002/0039096 | A1 | 4/2002 | Katsutani | |
| 2005/0162370 | A1 * | 7/2005 | Miyazaki | 345/98 |
| 2006/0028426 | A1 * | 2/2006 | Hiratsuka | 345/103 |
| 2006/0132419 | A1 | 6/2006 | Morita | |
| 2006/0227091 | A1 * | 10/2006 | Nohtomi et al. | 345/98 |

(Continued)

FOREIGN PATENT DOCUMENTS

JP 5-8592 U 2/1993

(Continued)

OTHER PUBLICATIONS

Office Action dated Apr. 27, 2010 for U.S. Appl. No. 11/785,755.

(Continued)

*Primary Examiner* — Amare Mengistu
*Assistant Examiner* — Jeffrey Steinberg
(74) *Attorney, Agent, or Firm* — McGinn IP Law Group PLLC

(57) ABSTRACT

A liquid crystal display (LCD) driver integrated circuit (IC) includes a grayscale voltage generating circuit generating grayscale voltages from a set of supply reference voltages. A converting section having connection terminals drives each of data lines of an LCD display panel through one of the connection terminals based on one of the grayscale voltages. The grayscale voltage generating circuit includes a resistance circuit having resistances connected in series and voltage buffers connected to the resistance circuit to bias the resistance circuit. When two of the LCD driver ICs are used, non-inversion input terminals of pairs of the voltage buffers in a first of the two LCD driver ICs and a corresponding voltage buffer in the second LCD driver IC are commonly connected to the reference voltage generating circuit, and connection terminals in the first LCD driver IC are connected to connection terminals in the second LCD driver IC.

20 Claims, 8 Drawing Sheets

U.S. PATENT DOCUMENTS

| | | | | |
|---|---|---|---|---|
| 2006/0244710 | A1 | 11/2006 | Iriguchi et al. | |
| 2007/0247408 | A1* | 10/2007 | Nishimura et al. | 345/89 |
| 2007/0290983 | A1* | 12/2007 | Kim et al. | 345/100 |
| 2009/0096816 | A1* | 4/2009 | Kamijo et al. | 345/690 |
| 2009/0096818 | A1* | 4/2009 | Nishimura et al. | 345/690 |
| 2009/0102777 | A1* | 4/2009 | Izumikawa et al. | 345/96 |

FOREIGN PATENT DOCUMENTS

| | | | |
|---|---|---|---|
| JP | 5-119744 | | 5/1993 |
| JP | 2590456 | | 12/1996 |
| JP | 10-142582 | | 5/1998 |
| JP | 2001-175226 | A | 6/2001 |
| JP | 2002-236473 | A | 8/2002 |
| JP | 2003-228348 | A | 8/2003 |
| JP | 2003-316333 | A | 11/2003 |
| JP | 2005-070338 | A | 3/2005 |
| JP | 2005-345808 | A | 12/2005 |

OTHER PUBLICATIONS

U.S. Appl. No. 11/785,755 Office Action dated Aug. 23, 2010.
Notification of Reasons for Refusal dated Nov. 8, 2011 (with an English translation).

* cited by examiner

LIQUID CRYSTAL DISPLAY APPARATUS CONTAINING DRIVER IC WITH GRAYSCALE VOLTAGE GENERATING CIRCUIT

BACKGROUND OF THE INVENTION

1. Field of the Invention

The present invention relates to a grayscale voltage generating circuit, a driver integrated circuit (IC) and a liquid crystal display apparatus, and more particularly relates to a liquid crystal display in which pixels are driven by a driver IC with a grayscale voltage generating circuit.

2. Description of the Related Art

In recent years, the number of grayscale levels in a color liquid crystal display (LCD) has been increased from 260,000 color levels in 6-bit representation to 16,700,000 color levels in 8-bit representation. Moreover, a product of 1,000,000,000 color levels in 10-bit representation has been developed. In such a situation, a grayscale voltage generating circuit is one of important basic circuits to generate voltages matched to γ characteristic of each liquid crystal panel. Conventionally, a grayscale power supply IC is provided independently from the IC for the LCD driver IC and is used to adjust the γ characteristic of the liquid crystal display driver (hereafter, to be referred to as an LCD driver).

However, the grayscale voltage generating circuit is built in each of a plurality of LCD driver ICs to reduce the cost of the liquid crystal display apparatus. In this case, the grayscale voltages outputted from the respective liquid crystal driver ICs indicate values different from each other, depending on offset voltages caused due to amplifiers of the grayscale power supply circuits. Thus, a problem of a display block unevenness is caused. In particular, in case that a LCD driver is stuck on COG (Chip On Glass) and wirings are formed, its wiring resistance is large. Thus, the γ characteristic changes for each LCD driver IC, depending on a current flowing through a γ resistance determining the γ characteristic. Therefore, this becomes a large factor involving the display block unevenness.

In operational amplifiers for a grayscale voltage generating circuit, typically, a 6-bit product has five amplifiers on a positive side and five amplifiers on a negative side. Also, an 8-bit product has nine amplifiers on a positive side and nine amplifiers on a negative side. In these amplifiers, a power supply efficiency is considered and its output voltage is in a range of a power supply voltage or a voltage close to the ground voltage (GND). Also, the grayscale voltage generating circuit is provided as a dedicated IC outside the LCD driver IC in many cases. However, there is a case that it is built in the LCD driver IC. In this case, since the amplifier must be composed of CMOS transistors, the driving performance of a driver is limited.

FIG. 1 is a block diagram showing the configuration of a conventional LCD source driver 1100A and a conventional LCD panel 1300. With reference to FIG. 1, the LCD source driver 1100A in the conventional example has a data register 11 for receiving 6-bit digital display data R, G and B, a latch circuit 12 for latching the digital display data in synchronization with a strobe signal ST, a D/A converter 13 composed of n-stage digital/analog converting circuits provided in parallel, a grayscale voltage generating circuit 14 for generating grayscale voltages having γ characteristic based on the characteristic of the LCD panel, and an output amplifier section 15 for buffering a voltage outputted from the D/A converter 13. Here, the output amplifier section 15 has n voltage followers $\mathbf{15}_1$ to $\mathbf{15}_n$.

The LCD panel 1300 has thin film transistors (TFTs) $\mathbf{16}_1$ to $\mathbf{16}_n$ provided at the intersection regions between data lines and scanning lines. Also, pixel capacitances $\mathbf{17}_1$ to $\mathbf{17}_n$ are connected to the TFTs $\mathbf{16}_1$ to $\mathbf{16}_n$. Here, gates of the TFTs $\mathbf{16}_1$ to $\mathbf{16}_n$ are connected to the scanning lines, and sources thereof are connected to the data lines. Also, ends of the pixel capacitances $\mathbf{17}_1$ to $\mathbf{17}_n$ on one side are connected to drains of the TFTs $\mathbf{16}_1$ to $\mathbf{16}_n$, and ends on the other side are connected to a COM node. FIG. 1 shows the TFTs $\mathbf{16}_1$ to $\mathbf{16}_n$ connected to one scanning line and the pixel capacitances $\mathbf{17}_1$ to $\mathbf{17}_n$. Usually, the LCD panel 1300 has a plurality of scanning lines. The TFTs $\mathbf{16}_1$ to $\mathbf{16}_n$ are connected to this scanning line and the data lines, and the pixel capacitances $\mathbf{17}_1$ to $\mathbf{17}_n$ are provided in the shape of an array. An LCD gate driver (not shown) sequentially drives the gates of the TFTs $\mathbf{16}_1$ to $\mathbf{16}_n$ connected to the scanning lines one by one. The D/A converter 13 performs D/A conversion on the 6-bit digital display data latched by the latch circuit 12 and sends to N voltage followers $\mathbf{15}_1$ to $\mathbf{15}_n$. Then, the D/A converter 13 sends data signals through the TFTs $\mathbf{16}_1$ to $\mathbf{16}_n$ to pixels as the pixel capacitances $\mathbf{17}_1$ to $\mathbf{17}_n$. Here, the grayscale voltage generating circuit 14 generates grayscale voltages as reference voltages for the data signal supplied on the data line. In the D/A converter 13, one of the grayscale voltages is selected by a decoder composed of a ROM switch (not shown). In a conventional grayscale voltage generating circuit disclosed in Japanese Patent No. 2590456 (first conventional example), a resistance ladder circuit is provided. This resistance ladder circuit is driven by voltage followers, in order to reduce impedance at an output node of each grayscale voltage and finely adjust the voltage value of the grayscale voltage.

FIG. 2 is a block diagram showing the configuration of the conventional grayscale voltage generating circuit 14. With reference to FIG. 2, the grayscale voltage generating circuit 14 is provided with a resistance ladder circuit 1102 built in an LCD source driver 1100A, an external resistance ladder circuit 1401 provided outside the LCD source driver 1100A; a buffer amplifier section 1101 having a plurality of operational amplifiers $OP_1$ to $OP_n$ functioning as voltage followers; and a constant voltage generating circuit for outputting a reference voltage $V_r$. Here, the built-in resistance ladder circuit 1102 has resistances $R_1$ to $R_{n-1}$ connected in series and respectively connected to the output ends of the operational amplifiers $OP_1$ to $OP_n$. Also, the external resistance ladder circuit 1401 has the constant voltage generating circuit and resistances $R_{0'}$ to $R_{n-1}$, connected in series. The resistances $R_{0'}$ to $R_{n-1}$, are connected to non-inversion input terminals of the operational amplifiers $OP_1$ to $OP_n$.

The operational amplifiers $OP_1$ to $OP_n$ output grayscale voltages $V_{g1}$ to $V_{gn}$ based on tap voltages of the resistances $R_{0'}$ to $R_{n-1}$, in the external resistance ladder circuit 1401. Here, the resistances $R_{0'}$ to $R_{n-1'}$ in the external resistance ladder circuit 1401 are variable resistances. By changing those resistance values, the tap voltages applied to the operational amplifiers $OP_1$ to $OP_n$ are adjusted. At this time, the voltages applied to the operational amplifiers $OP_1$ to $OP_n$ are adjusted such that the grayscale voltages $V_{g1}$ to $V_{gn}$ outputted from the external resistance ladder circuit 1401 are the optimal voltages for the characteristic of the LCD panel 1300.

The reference voltage $V_r$ is supplied to the grayscale voltage generating circuit 14. The reference voltage $V_r$ is generated by a stable external constant voltage generating circuit such as a band gap reference. The grayscale voltages $V_{gn}$, $V_{gn-1}$, $V_{gn-2}$, - - - , $V_{g2}$ and $V_{g1}$ are finally determined based on the ladder resistances $R_{0'}$, $R_{1'}$, $R_{2'}$, - - - , $R_{n-2'}$ and $R_{n-1'}$, respectively. That is, the grayscale voltages $V_{gn}$, $V_{gn-1}$, $V_{gn-2}$, - - - , $V_{g2}$ and $V_{g1}$ are determined as follows.

$$V_{gn}=V_r V_{gn-1}=V_r\{(R_{n-2'}+R_{n-3'}+\ldots+R_{0'})/(R_{n-1'}+R_{n-2'}+R_{n-3'}+\ldots+R_{0'})\},\ldots,$$

$$V_{g1}=V_r\{R_{0'}/(R_{n-1'}+R_{n-2'}+R_{n-3'}+\ldots+R_{0'})\}$$

Here, if a resistance ratio of the resistances $R_1$ to $R_{n-1}$ to determine the grayscale voltages $V_{g1}$ to $V_{gn}$ in an LCD source driver 10 and a resistance ratio of the resistances $R_{1'}$ to $R_{n-1'}$ to determine the grayscale voltages $V_{g1}$ to $V_{gn}$ are equal to each other, the output currents of the operational amplifiers $OP_2$ to $OP_{n-1}$ become zero.

However, an output current $I_n$ in the n-th operation amplifier $OP_n$ (the operational amplifier that outputs the maximum grayscale voltage $V_{gn}$) is given by the following equation (1) in a discharge direction $$I_n=(V_{gn}-V_{g1})/(R_1+R_2+\ldots+R_{n-1} \quad (1)$$

Also, an output current $I_1$ of the first operational amplifier $OP_1$ (the operational amplifier that outputs the minimum grayscale voltage $V_{g1}$) is given by the following equation (2) in the discharge direction.

$$I_1=(V_{gn}-V_{g1})/(R_1+R_2+\ldots+R_{n-1}) \quad (2)$$

Thus, the operation amplifier $OP_n$ and the operation amplifier $OP_1$ need to be designed as the output stages that can output the output currents $I_n$ and $I_1$, respectively. In particular, when they are designed by using MOS transistors, a mutual conductance gm of the MOS transistor which determines a drive performance is small as compared with a bipolar transistor. Therefore, attention should be paid thereto.

Also, Japanese Laid Open Patent Application (JP-A-Heisei 10-142582: second conventional example) discloses a technique in which reduction in an output dynamic range of an operational amplifier is improved in a liquid crystal grayscale voltage generating circuit.

Also, an LCD driver in which a plurality of LCD driver ICs are connected in parallel to increase the number of grayscale levels to be displayed on a liquid crystal is disclosed in Japanese Laid Open Patent Application (JP-A-Heisei 5-119744: third conventional example). FIG. 3 is a block diagram showing the configuration of an LCD source driver 1100B using two LCD source driver ICs, each of which has a built-in grayscale voltage generating circuit. With reference to FIG. 3, the LCD source driver 1100B has a first LCD source driver IC 110-1 and a second LCD source driver IC 110-2. The first LCD source driver IC 110-1 is provided with a grayscale voltage generating circuit 14'-1, a data register 11-1, a latch circuit 12-1, a D/A converter 13-1 and an output amplifier section 15-1. The grayscale voltage generating circuit 14'-1 is provided with a negative side grayscale resistance group 142-1 composed of a group of resistances $R_1$-1 to $R_{(n/2)-1}$-1 and a positive side grayscale resistance group 141-1 composed of a group of resistances $R_{(n/2)+1}$-1 to $R_{n-1}$-1; operational amplifiers $\mathbf{143}_1$-1 and $\mathbf{143}_2$-1 which are connected to the negative side grayscale resistance group 142-1; and operational amplifiers $\mathbf{143}_3$-1 and $\mathbf{143}_4$-1 which are connected to the positive side grayscale resistance group 141-1. The configuration of the second LCD source driver IC 110-2 is similar to that of the first LCD source driver IC 110-1. The reference numerals of the similar components are used in which an additional number "1" of the component of the first LCD source driver IC 110-1 is replaced with "2".

The non-inversion input terminals of the operational amplifiers $\mathbf{143}_4$-1 and $\mathbf{143}_4$-2 are connected to a first constant voltage source $V_{H+}$ and the non-inversion input terminals of the operational amplifiers $\mathbf{143}_3$-1 and $\mathbf{143}_3$-2 are connected to a second constant voltage source $V_{L+}$ for supplying a voltage lower than the first constant voltage source $V_{H+}$. Thus, the operational amplifier $\mathbf{143}_4$-1 supplies the highest voltage to the positive side grayscale resistance group 141-1. Similarly, the operational amplifier $\mathbf{143}_4$-2 supplies the highest voltage to the positive side grayscale resistance group 141-2. Also, the operational amplifier $\mathbf{143}_3$-1 supplies the lowest voltage to the positive side grayscale resistance group 141-1. Similarly, the operational amplifier $\mathbf{143}_3$-2 supplies the lowest voltage to the positive side grayscale resistance group 141-2. Moreover, the non-inversion input terminals of the operational amplifiers $\mathbf{143}_2$-1 and $\mathbf{143}_2$-2 are connected to a third constant voltage source $V_{H-}$, and the non-inversion input terminals of the operational amplifiers $\mathbf{143}_1$-1 and $\mathbf{143}_1$-2 are connected to a fourth constant voltage source $V_{L-}$ for supplying a voltage lower than the third constant voltage source $V_{H-}$. Thus, the operational amplifier $\mathbf{143}_2$-1 supplies the highest voltage to the negative side grayscale resistance group 142-1. Similarly, the operational amplifier $\mathbf{143}_2$-2 supplies the highest voltage to the negative side grayscale resistance group 142-2. Also, the operational amplifier $\mathbf{143}_1$-1 supplies the lowest voltage to the negative side grayscale resistance group 142-1. Similarly, the operational amplifier $\mathbf{143}_1$-2 supplies the lowest voltage to the negative side grayscale resistance group 142-2. Also, when the two or more LCD source driver ICs are used, the non-inversion input terminals of the operational amplifiers are commonly connected to the power supply voltages, respectively.

In the first to fourth constant voltage sources $V_{H+}$, $V_{L+}$, $V_{H-}$ and $V_{L-}$, since they are usually constituted to use resistance division, their impedances are high. Thus, buffer amplifiers are required. In this example, the operational amplifiers $\mathbf{143}_1$ to $\mathbf{143}_4$ carry out the roles as the buffer amplifiers. The LCD panel changes the brightness in response to the output from the LCD source driver 1100B having such a configuration. For example, in the LCD panel of a normally white type, the values of the first to fourth constant voltage sources $V_{H+}$, $V_{L+}$, $V_{H-}$ and $V_{L-}$ are set such that the high voltage side of the positive side grayscale corresponds to a black level, the low voltage side corresponds to a white level, the low voltage side of the negative side grayscale corresponds to the black side, and the high voltage side corresponds to the white level.

As mentioned above, in the conventional technique, the LCD source driver contains the plurality of LCD source driver ICs. In this case, a variation in the ladder resistances is caused in each LCD source driver IC. Accordingly, the grayscale characteristic is different among the respective driver ICs, and a problem of the display block unevenness is caused. Moreover, the difference in the offset voltage of the operational amplifier for the grayscale voltage generating circuit, which is built in the LCD driver, causes the generation of the grayscale voltage that is different between the LCD source driver ICs. Therefore, there is a possibility that the problem of the display block unevenness is caused. In detail, the grayscale voltage is determined based on resistance division in each LCD source driver IC. A resistance division ratio is varied for each LCD source driver IC, although this is natural. As a result, the grayscale characteristics of the first LCD source driver IC 110-1 and second LCD source driver IC 110-2 are different. In this case, if the two driver ICs are arranged systematically and the liquid crystal panel is driven in response to the data signals based on the respective grayscale voltages, the boundary between the LCD panels driven by the respective driver ICs can be recognized by a human's eye. It should be noted that the human's eye is said to be possible to recognize the difference of 10 mV in the voltage applied to the liquid crystal, as the different grayscale.

In order to solve the above problems, the outputs of the grayscale power supply operational amplifiers are considered to be commonly connected. However, in the conventional technique, the offset voltages of the respective operational amplifiers are different. Thus, if the outputs are short-circuited, the power supply operational amplifier is abnormally operation. For this reason, it is difficult to connect the outputs of the grayscale power supply operational amplifiers to each other. Therefore, in the conventional examples, it is difficult to commonly connect the LCD driver ICs in which the grayscale voltage generating circuits are built.

SUMMARY

In an aspect of the present invention, a liquid crystal display (LCD) driver integrated circuit includes a grayscale voltage generating circuit configured to generate a plurality of grayscale voltages from a set of supply reference voltages; and a converting section having connection terminals and configured to drive each of a plurality of data lines of a liquid crystal display panel through one of the connection terminals based on one of the plurality of grayscale voltages which is determined based on an input data, when each of a plurality of scanning lines of the liquid crystal display panel is driven. The grayscale voltage generating circuit includes a resistance circuit having resistances connected in series; and a plurality of voltage buffers connected to the resistance circuit to bias the resistance circuit. When two of the LCD driver integrated circuits are used, non-inversion input terminals of pairs of one of the plurality of voltage buffers in one of the two LCD driver integrated circuits and corresponding one of the plurality of voltage buffers in the other of the two LCD driver integrated circuits are connected in common to the reference voltage generating circuit, and a part of the connection terminals in one of the two LCD driver integrated circuits and a corresponding part of the connection terminals in the other of the two LCD driver integrated circuits are connected to each other.

Here, the plurality of voltage buffers includes two voltage buffers connected to ends of the resistance circuit.

Also, the grayscale voltage generating circuit may further include a protection resistance connected between the resistance circuit and an output of each of the two voltage buffers.

Also, all of the connection terminals in one of the two LCD driver integrated circuits and all of the connection terminals in the other of the two LCD driver integrated circuits may be connected to each other.

Also, all of the connection terminals other than the connection terminal corresponding to the ends in one of the two LCD driver integrated circuits and all of the connection terminals other than the connection terminal corresponding to the ends in the other of the two LCD driver integrated circuits may be connected to each other.

In this case, the grayscale voltage generating circuit may include the plurality of voltage buffers connected to nodes between the resistances of the resistance circuit to bias the resistance circuit. The reference voltage generating circuit may generate the set of supply reference voltages for the plurality of voltage buffers.

In another aspect of the present invention, an liquid crystal display (LCD) apparatus includes an LCD panel having a plurality of data lines and a plurality of scanning lines, wherein pixels are provided at intersections of the plurality of data lines and the plurality of scanning lines; a reference voltage generating circuit configured to generate a set of supply reference voltages; and two driver integrated circuits connected to each other through the plurality of data lines. Each of the plurality of driver integrated circuits includes a grayscale voltage generating circuit configured to generate a plurality of grayscale voltages from the set of supply reference voltages; and a converting section having connection terminals and configured to drive each of the plurality of data lines through one of the connection terminals based on one of the plurality of grayscale voltages which is determined based on an input data, when each of the plurality of scanning lines is driven. The grayscale voltage generating circuit includes a resistance circuit having resistances connected in series; and a plurality of voltage buffers connected to the resistance circuit to bias the resistance circuit. Non-inversion input terminals of pairs of one of the plurality of voltage buffers in one of the two driver integrated circuits and corresponding one of the plurality of voltage buffers in the other of the two driver integrated circuits are connected in common to the reference voltage generating circuit. At least a part of the connection terminals in one of the two driver integrated circuits and a corresponding part of the connection terminals in the other of the two driver integrated circuits are connected to each other.

According to the present invention, it is possible to improve the image quality of the liquid crystal displaying panel that is driven by using the plurality of driver ICs. Also, it is possible to improve the displaying trouble (block unevenness) in the liquid crystal displaying panel.

DESCRIPTION OF THE PREFERRED EMBODIMENTS

Figure 1:
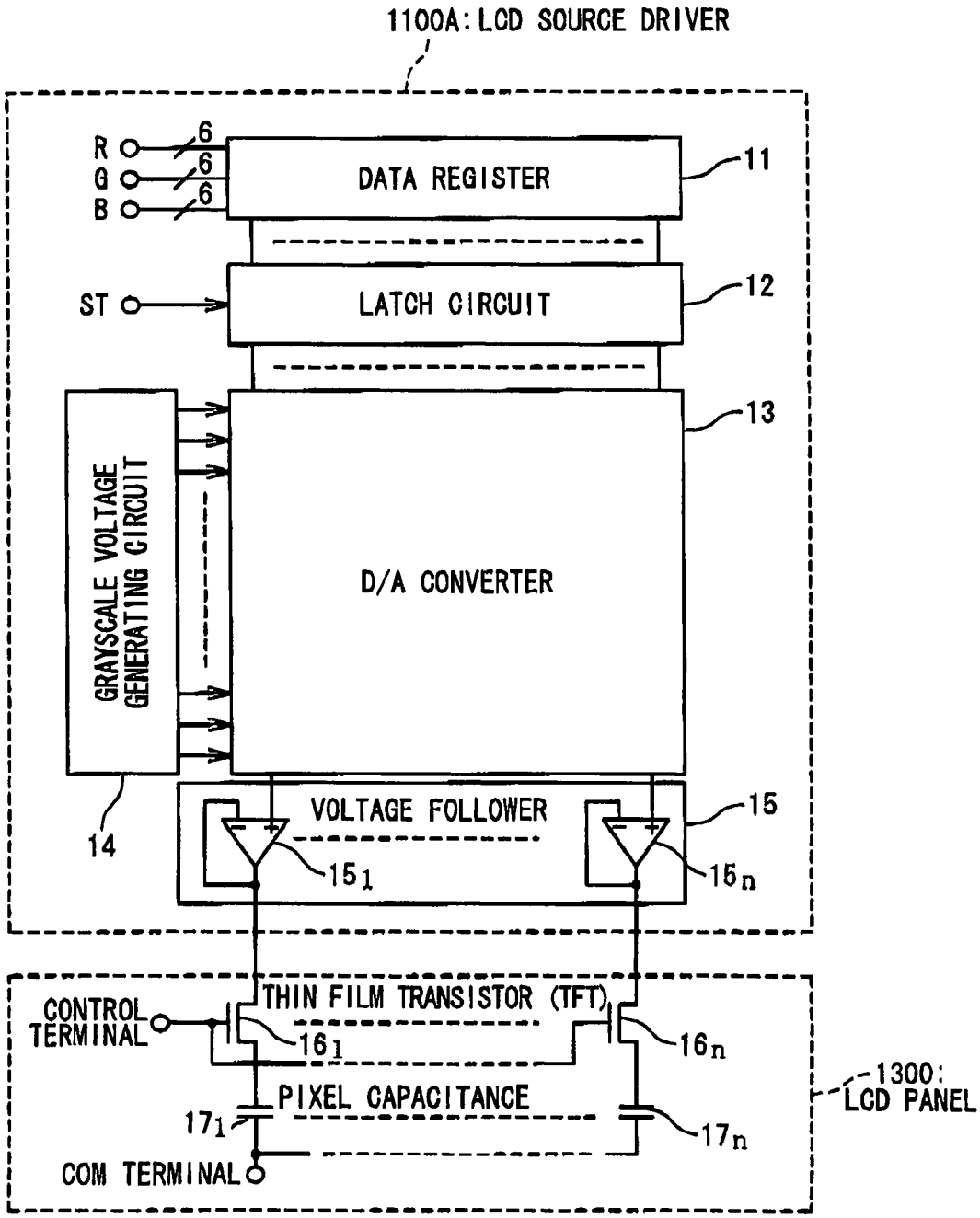
Fig. 1 PRIOR ART
FIG. 1 is a block diagram showing a configuration of a conventional liquid crystal display apparatus.
Figure 2:
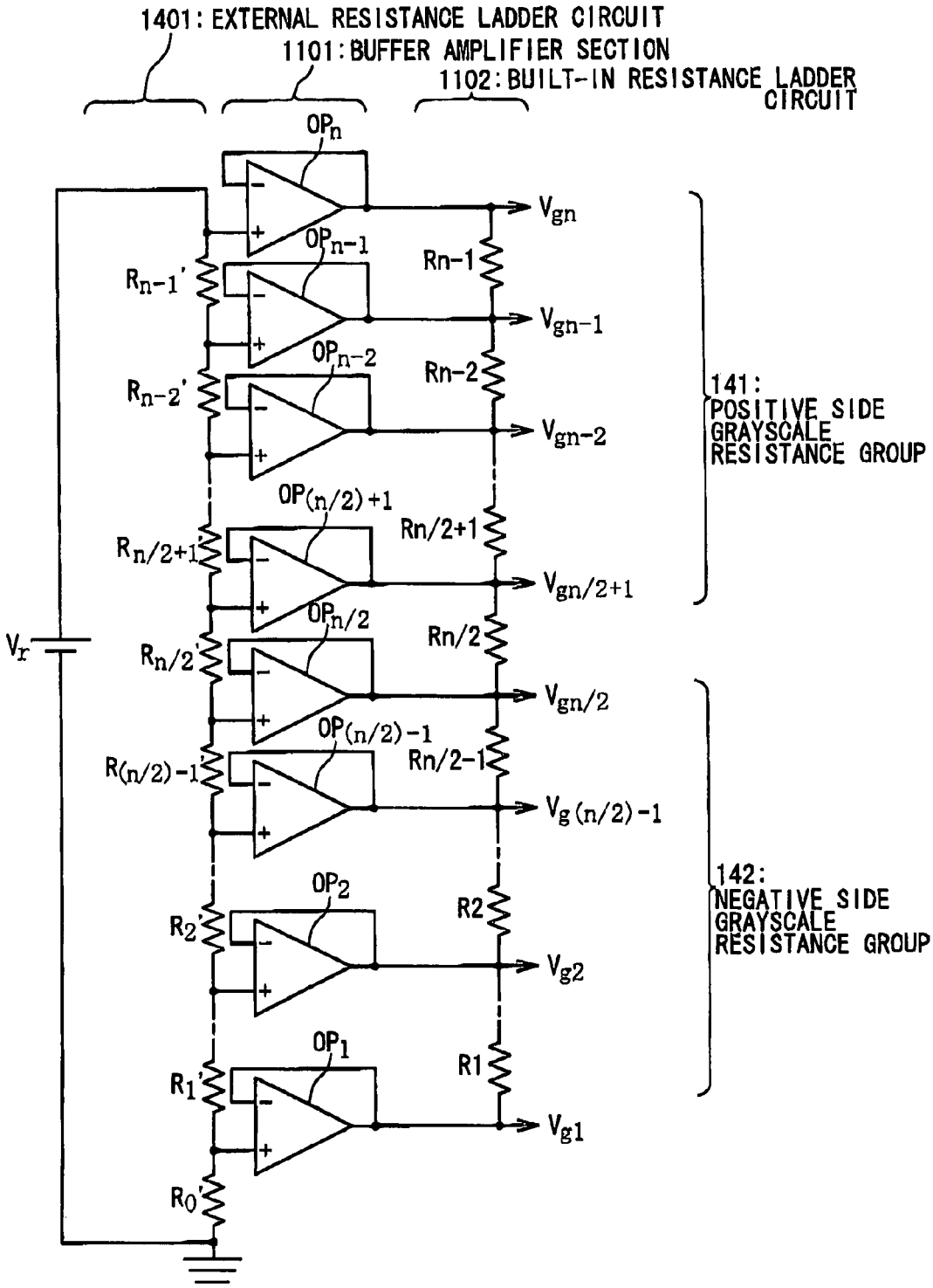
Fig. 2 PRIOR ART
FIG. 2 is a block diagram showing a configuration of a grayscale voltage generating circuit in the conventional liquid crystal display apparatus.
Figure 3:
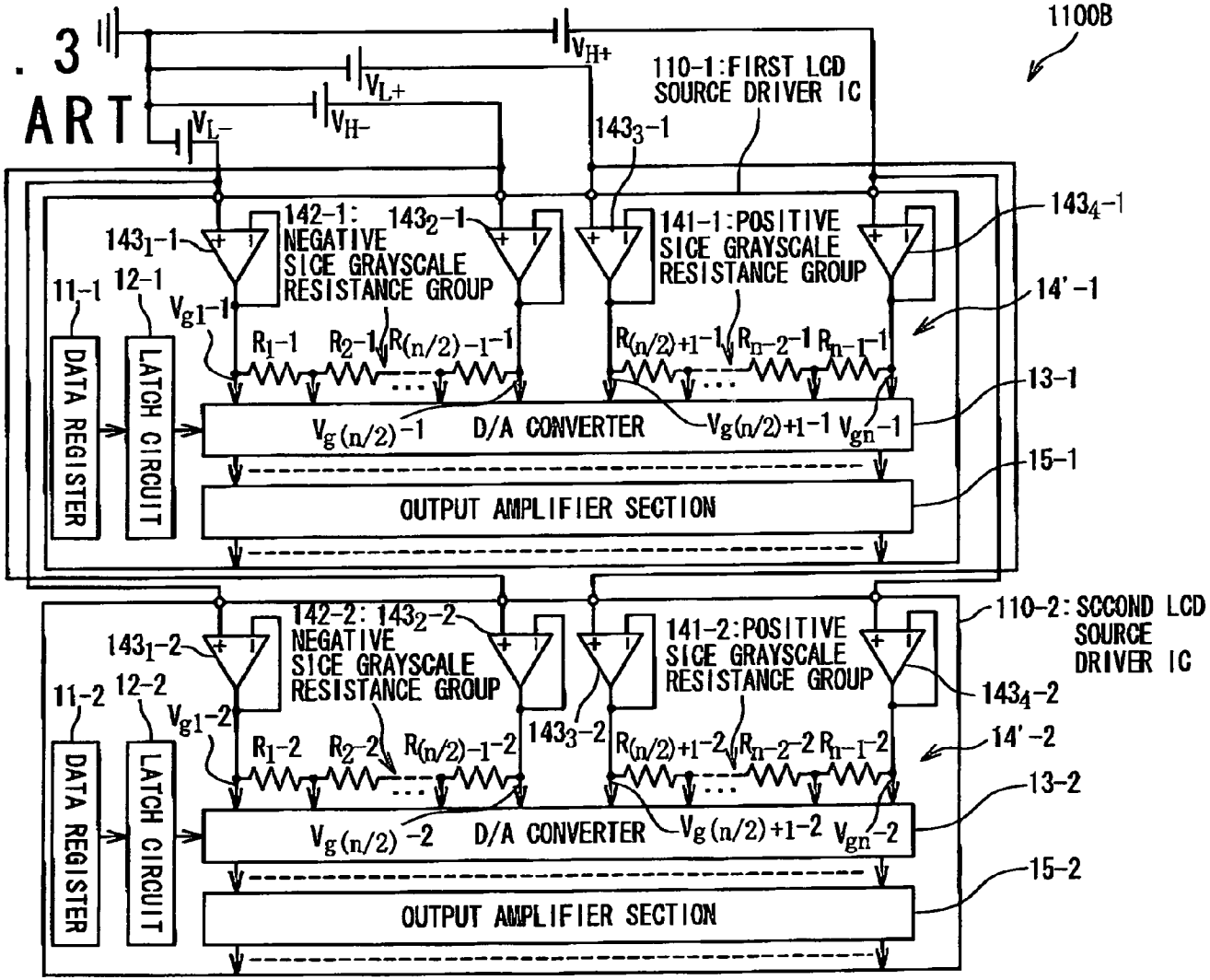
Fig. 3 PRIOR ART
FIG. 3 is a block diagram showing a configuration of a plurality of LCD source driver ICs according to a conventional liquid crystal display apparatus.

Hereinafter, a liquid crystal display apparatus containing a source driver with a grayscale voltage generating circuit according to the present invention will be described in detail with reference to the attached drawings. In the drawings, the same or similar reference numerals and symbols indicate the same, similar or equivalent components.

(Configuration of Liquid Crystal Display Apparatus)

Figure 4:
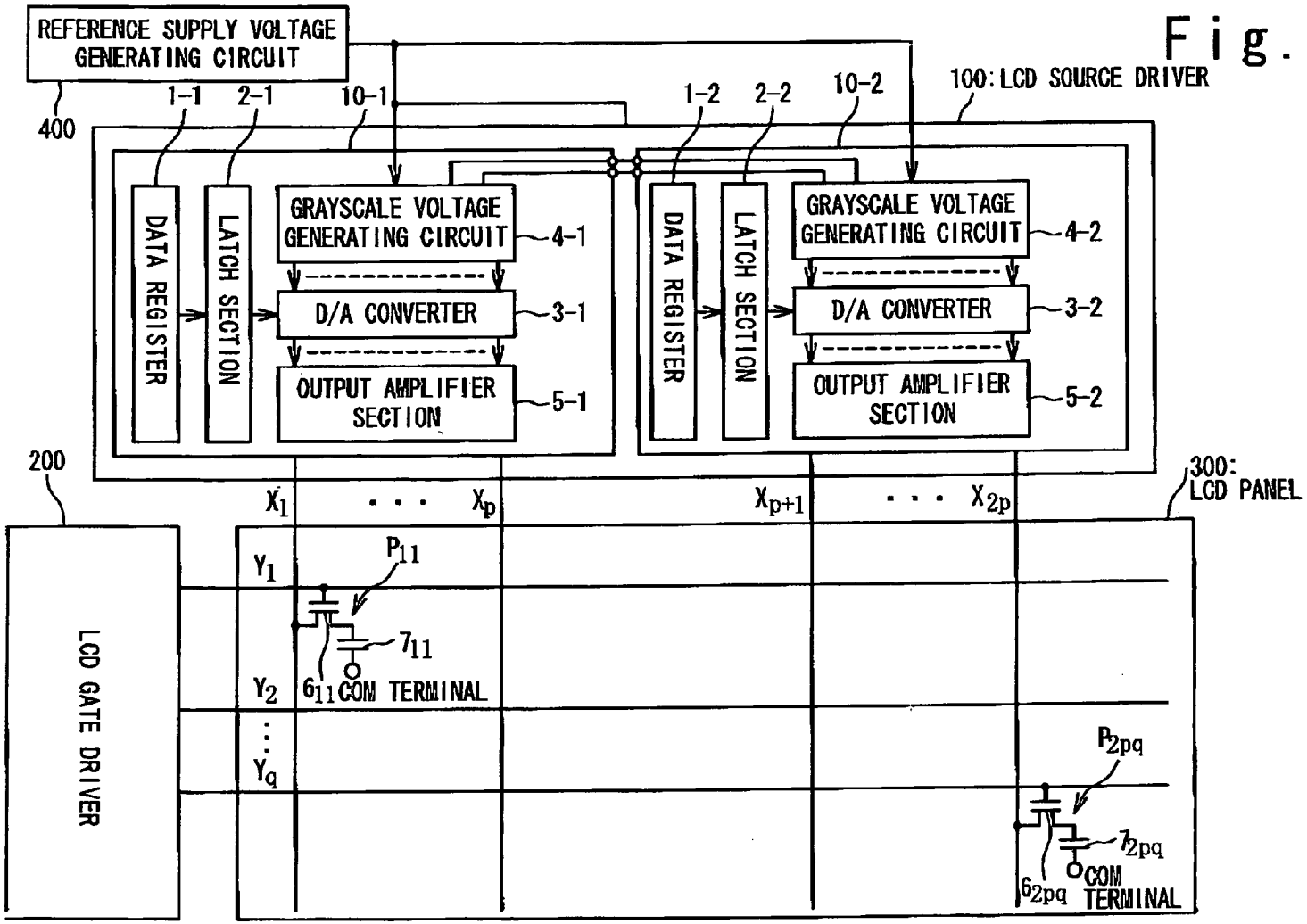
FIG. 4 is a block diagram showing a configuration of a liquid crystal display according to the present invention.

FIG. 4 is a block diagram showing the configuration of the liquid crystal display apparatus according to the first embodiment of the present invention. With reference to FIG. 4, the liquid crystal display apparatus according to the present invention has an LCD (Liquid Crystal Display) source driver 100, an LCD gate driver 200, an LCD panel 300 and a reference voltage generating circuit 400. On the LCD panel 300, there are a plurality of data lines $X_1$ to $X_{2p}$ (p is a natural number of 2 or more) arrayed in a row direction; a plurality of scanning lines $Y_1$ to $Y_q$ (q is a natural number of 2 or more) arrayed in a column direction, and pixels $P_{11}$ to $P_{2qp}$ provided in regions in which the data lines $X_1$ to $X_{2p}$ and the scanning lines $Y_1$ to $Y_q$ intersect. Here, the pixels $P_{11}$ to $P_{2qp}$ have TFTs (Thin Film Transistor) $\mathbf{6}_{11}$ to $\mathbf{6}_{2pq}$ and pixel capacitances $\mathbf{7}_{11}$ to $\mathbf{7}_{2pq}$. The gates of the TFTs $\mathbf{6}_{11}$ to $\mathbf{6}_{2pq}$ are connected to the scanning lines $Y_1$ to $Y_q$, and sources are connected to the data lines $X_1$ to $X_{2pq}$. Also, ends of the pixels $\mathbf{7}_{11}$ to $\mathbf{7}_{2pq}$ on one side are connected to drains of the TFTs $\mathbf{6}_{11}$ to $\mathbf{6}_{2pq}$, and the other ends thereof are connected through a COM terminal to a common electrode. Hereinafter, for example, the pixel provided at the position at which the data line $X_p$ and the scanning line $Y_q$ intersect is referred to as the pixel $P_{pq}$.

The LCD source driver 100 has a plurality of LCD source driver ICs 10 and drives the data lines X in the LCD panel 300. The LCD source driver 100 in this embodiment has two LCD source driver ICs 10-1 and 10-2 as an example. The LCD source driver IC 10-1 outputs data signals to drive the data lines $X_1$ to $X_p$. The LCD source driver IC 10-2 outputs the data signals to drive the data lines $X_{p+1}$ to $X_{2p}$. Hereinafter, the additional numbers "–1" and "–2" are added to the components provided in the LCD source drivers ICs 10-1 and 10-2. Also, when the LCD source driver IC 10-1 and the LCD source driver IC 10-2 are not discriminated, they will be described under the assumption that the additional numbers are not added.

Each LCD source driver IC 10 is provided with a data register 1 for acquiring digital display data R, G and B; a latch circuit 2 for latching the digital display data in synchronization with a strobe signal ST; a D/A converter 3 composed of digital/analog converting circuits of n parallel stages; a grayscale voltage generating circuit 4 having a gamma conversion characteristic corresponding to a characteristic of a liquid crystal; and an output amplifier section 5 for buffering a voltage outputted from the D/A converter 3.

The grayscale voltage generating circuit 4 generates grayscale voltages $V_{g1}$ to $V_{gn}$ serving as the reference voltages for the data signals that indicates the grayscale of each pixel P. In accordance with the reference voltages supplied from the reference voltage generating circuit 400 provided outside the LCD source driver 100, the grayscale voltage generating circuit 4 applies the grayscale voltages $V_{g1}$ to $V_{gn}$ to the D/A converter 3. The number n of grayscale voltages $V_{g1}$ to $V_{gn}$ is arbitrary. However, in case of a 6-bit product, for example, when n=10, the grayscale voltages $V_{g1}$ to $V_{10}$ are outputted. Here, although it is omitted, the grayscale voltage $V_g$ is divided by the resistances and outputted to the D/A converter 3. In case of the 6-bit product, the grayscale voltages corresponding to 64 grayscale levels based on the resistance division are outputted to the D/A converter 3. In the D/A converter 3, the grayscale voltage is selected by a decoder composed of ROM switches (not shown). Also, the selected grayscale voltage is converted into a display signal that is an analog signal, and amplified by the output amplifier section 5 and outputted to each data line X, and each pixel P is driven.

As described later, a part or all of nodes N in which the grayscale voltages are generated in the grayscale voltage generating circuit 4 according to the present invention is commonly connected to a part or all of nodes N in which the grayscale voltages are generated by a different grayscale voltage generating circuit 4, and have the same voltage. For this reason, the magnitudes of the display signals based on the same grayscale voltage outputted by the adjacent LCD driver ICs 10-1 and 10-2 can be made uniform, thereby improving the block unevenness. That is, one feature of the present invention is in the configuration in which the nodes having the grayscale voltages determined based on the resistance division are commonly connected and set at the same voltage between the plurality of driver ICs. The present invention will be described below in detail in the first to third embodiments.

First Embodiment

The liquid crystal display according to the first embodiment of the present invention will be described below with reference to FIGS. 4 and 5. The liquid crystal display in the first embodiment is configured in such a manner that the LCD source driver 100 shown in FIG. 4 is defined as an LCD source driver 100A, and the reference voltage generating circuit 400 is defined as a reference voltage generating circuit 400A.

Figure 5:
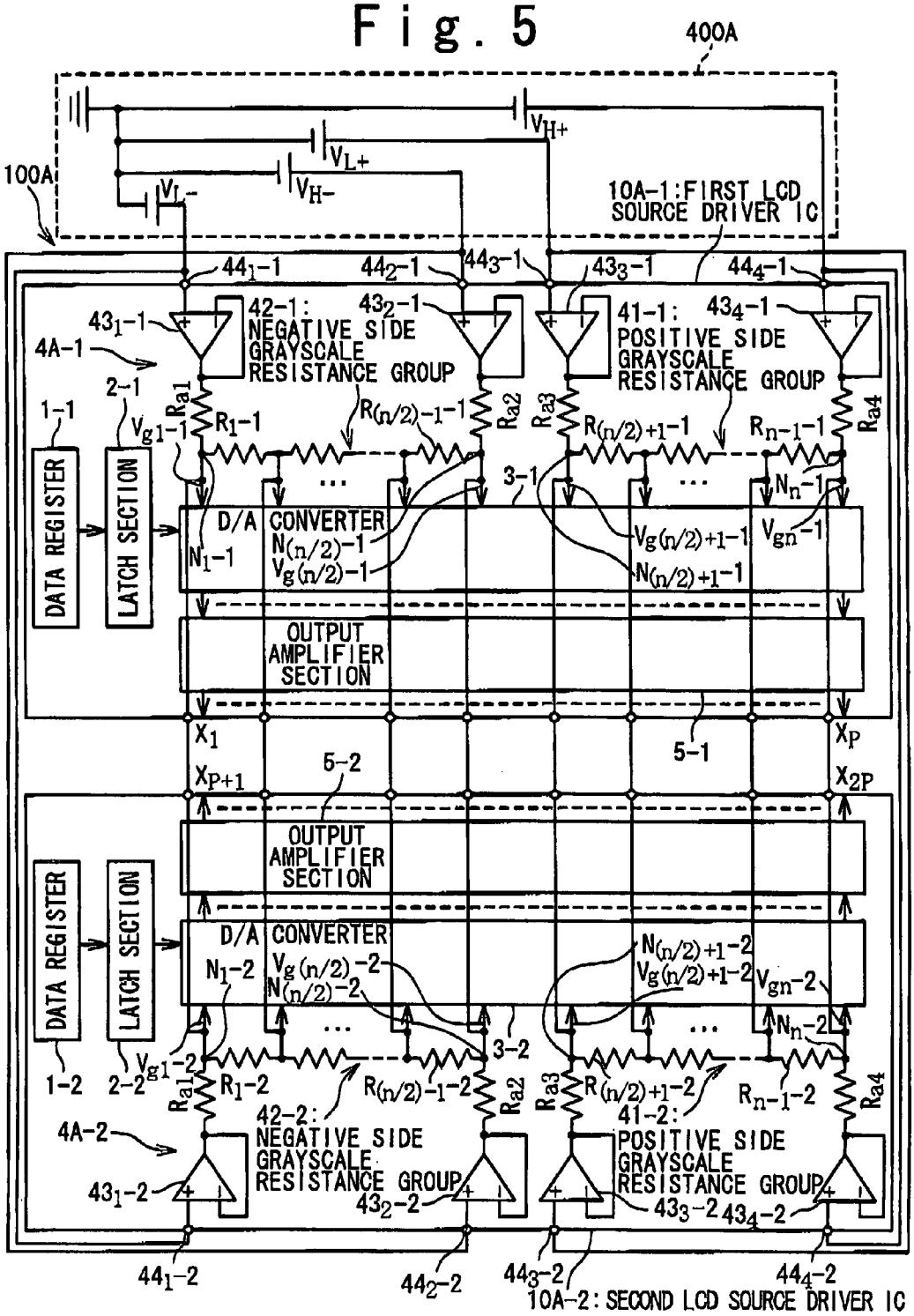
FIG. 5 is a block diagram showing a configuration of an LCD source driver according to a first embodiment of the present invention.

FIG. 5 is a block diagram showing the configuration of the LCD source driver 100A in the first embodiment. With reference to FIG. 5, the LCD source driver 100A has a first LCD source driver IC 10-1 and a second LCD source driver IC 10-2. An LCD source driver IC 10A has a grayscale voltage generating circuit 4A, the data register 1, the latch section 2, the D/A converter 3 and the output amplifier section 5.

The grayscale voltage generating circuit 4A is provided with a positive side grayscale resistance group 41, a negative side grayscale resistance group 42, four operational amplifiers $\mathbf{43}_1$ to $\mathbf{43}_4$ that are the operational amplifier circuits forming voltage followers, and four resistances $R_{a1}$ to $R_{a4}$. The negative side grayscale resistance group 42 is composed of resistances $R_1$ to $R_{(n/2)-1}$. The resistances $R_1$ to $R_{(n/2)-1}$ are connected in series through nodes $N_2$ to $N_{(n/2)-1}$, in turns. Also, one end of the $R_1$ that is not connected to the resistance $R_2$ is connected through the node $N_1$ to the resistance $R_{a1}$, and one end of the $R_{(n/2)-1}$ that is not connected to the resistance $R_{(n/2)-2}$ is connected through the node $N_{(n/2)}$ to the resistance $R_{a2}$. The positive side grayscale resistance group 41 is composed of resistances $R_{(n/2)+1}$ to $R_{n-1}$. The resistances $R_{(n/2)+1}$ to $R_{n-1}$ are connected in series through the nodes $N_{(n/2)+2}$ to $N_{n-1}$ in turn. Also, one end of the resistance $R_{(n/2)+1}$ that is not connected to the resistance $R_{(n/2)+2}$ is connected through the node $N_{(n/2)+1}$ to the resistance $R_{a3}$ and one end of the resistance $R_{n-1}$ that is not connected to the resistance $R_{n-2}$ is connected through the node $N_n$ to the resistance $R_{a4}$.

The output ends of the operational amplifiers $\mathbf{43}_1$ and $\mathbf{43}_2$ are connected through the resistances $R_{a1}$ and $R_{a2}$ to the nodes $N_1$, $N_{(n/2)}$ of the negative side grayscale resistance group, respectively. Also, the output ends of the operational amplifiers $\mathbf{43}_3$ and $\mathbf{43}_4$ are connected to the nodes $N_{(n/2)+1}$ and $N_n$ of the positive side grayscale resistance group through the resistances $R_{a3}$ and $R_{a4}$ respectively. Here, the reference voltage generating circuit 400A has constant voltage sources $V_{H+}$, $V_{L+}$, $V_{H-}$ and $V_{L-}$. A non-inversion input terminal $\mathbf{44}_4$ of the operational amplifier $\mathbf{43}_4$ is connected to the constant voltage source $V_{H+}$, and a non-inversion input terminal $\mathbf{44}_3$ of the operational amplifier $\mathbf{43}_3$ is connected to the constant voltage source $V_{L+}$ that supplies a voltage lower than the first constant voltage source $V_{H+}$. Thus, the operational amplifier $\mathbf{43}_4$ supplies the highest voltage in the positive side grayscale resistance group 41 to the node $N_n$. Similarly, the operational amplifier $\mathbf{43}_3$ supplies the lowest voltage in the positive side grayscale resistance group 41 to the node $N_{(n/2)+1}$. Moreover, a non-inversion input terminal $\mathbf{44}_2$ of the operational amplifier $\mathbf{43}_2$ is connected to the third constant voltage source $V_{H-}$, and a non-inversion input terminal $\mathbf{44}_1$ of the operational amplifier $\mathbf{43}_1$ is connected to the fourth constant voltage source $V_{L-}$ that supplies a voltage lower than the third constant voltage source $V_{H-}$. Thus, the operational amplifier $\mathbf{43}_3$ supplies the highest voltage in the negative side grayscale resistance group 42 to the node $N_{(n/2)}$. Similarly, the operational amplifier $43_1$ supplies the lowest voltage in the negative side grayscale resistance group 42 to the node $N_1$. As for the magnitudes of the reference voltages supplied from the constant voltage sources $V_{H+}$, $V_{L+}$, $V_{H-}$ and $V_{L-}$, for example, in the LCD panel of the normally white type, the values of the first to fourth voltages $V_{H+}$, $V_{L+}$, $V_{H-}$ and $V_{L-}$ are set such that the high voltage side of the positive side grayscale resistance group 41 corresponds the white level, the low voltage side corresponds to the black level, the low voltage side of the negative side grayscale resistance group 42 corresponds to the black level, and the high voltage side corresponds to the white level.

The negative side grayscale resistance group 42 and the positive side grayscale resistance group 41 are connected to the D/A converter 3 through the nodes $N_1$ to $N_n$. The respective nodes $N_1$ to $N_n$ supply the grayscale voltages $V_{g1}$ to $V_{gn}$, which are based on the voltages supplied from the operational amplifiers $43_1$ to $43_4$, to the D/A converter 3. On the other hand, the nodes $N_{1-1}$ to $N_n$-1 in the first LCD source driver IC 10A-1 and the nodes $N_1$-2 to $N_n$-2 in the corresponding second LCD source driver IC 10A-2 are commonly connected. Thus, the grayscale voltages $V_{g1}$-1 to $V_{gn}$-1 in the first LCD source driver IC 10A-1 and the grayscale voltages $V_{g1}$-2 to $V_{gn}$-2 in the second LCD source driver IC 10A-2 have the same voltages, respectively.

As mentioned above, in the LCD source driver 100A according to the present embodiment, the non-inversion input terminals 44-1 and 44-2 of the respective operational amplifiers 43-1 to 43-2 in the two LCD source driver ICs 10A-1 and 10A-2 are commonly connected to the reference voltage generating circuit 400A, and between the two LCD source driver ICs 10A-1 and 10A-2, they are connected in parallel to the nodes $N_1$-1 to $N_n$-1 and the nodes $N_1$-2 to $N_n$-2 that supply the grayscale voltages $V_{g1}$ to $V_{gn}$. Also, the resistance $R_a$ for preventing the abnormal current from flowing due to the shorted state between the output ends of the operational amplifiers 43-1 and 43-2 is provided between the operational amplifier 43 and the positive side grayscale resistance group 41 and the negative side grayscale resistance group 42, in each LCD source driver IC 10A.

(operation of LCD Source Driver 100A in First Embodiment)

With reference to FIG. 5, this shows a design example of a resistance value of the resistance $R_a$. Here, the design example of the resistance value of the resistance $R_a$ is indicated by paying attention to the grayscale voltage $V_{gn}$ at the node $N_n$. A voltage value of the grayscale voltage $V_{gn}$ is assumed to be $V_{+1}$. That is, the voltage values of the nodes $N_n$-1 and $N_n$-2 that are a common connection point of the LCD source driver IC 10 are assumed to be $V_{+1}$. Also, an offset voltage of the operational amplifier $43_4$-1 in the first LCD source driver IC 10A-1 is assumed to be $V_{IO1}$, an offset voltage of the operational amplifier $43_4$-2 in the second LCD source driver IC 10A-2 is assumed to be $V_{IO2}$, a resistance value of the resistance $R_{a4}$ added to the output of the operational amplifier $43_4$ is assumed to be $R_a$, and the total resistance value in all of the resistances $R_{(n/2)+1}$ to $R_{n-1}$ in the positive side grayscale resistance group 41 is assumed to be $R_{+1}$. Moreover, when the influences of the offset voltage of the operational amplifier $43_3$ and the additional resistance $R_{a3}$ connected to the output of the operational amplifier $43_3$ are ignored, the voltage value at the node $N_{(n/2)+1}$ becomes $V_{L+}$. Here, when the law of [superposition Principle] is used, the $V_{+1}$ is calculated as follows.

$$V_{+1} = (V_{H+} + V_{I01})\frac{R_a // (R_{+1}/2)}{R_a + R_a // (R_{+1}/2)} + (V_{H+} + V_{I02})\frac{R_a // (R_{+1}/2)}{R_a + R_a // (R_{+1}/2)} + V_{L+}\frac{R_a}{R_a + R_{+1}}$$

Here, in the actual design, $R_a \ll R_{+1}$. Thus, $R_a//(R_{+1}/2) \approx Ra$. Therefore, the $V_{+1}$ is approximately represented by the equation (2).

$$V_{+1} \equiv V_{H+}\frac{V_{I01} + V_{I02}}{2}$$

The equation (2) indicates that the value $V_{+1}$ of the grayscale voltage $V_g$, which is supplied to the D/A converter 3 from the node $N_n$, is the value where an average value $(V_{IO1}+V_{IO2})/2$ of the offset voltages in the two operational amplifiers $43_4$-1 and $43_4$-2 is added to the reference voltage $V_{H+}$. That is, the offset voltages of the grayscale power supply operational amplifiers in the respective LCD source driver ICs 10A-1 and 10A-2 are averaged, and the displaying grayscale is determined at the common grayscale voltage. Thus, even if the different LCD source driver ICs 10A-1 and 10A-2 drive the data lines X in response to the grayscale voltage based on the same reference supply power supply, the display block unevenness is never generated in the LCD panel 300.

The current value flowing through the operational amplifier 43 will be verified below. When the output current value flowing through the operational amplifier 43 is assumed to be $I_{Ra1}$, this is represented by the equation (3).

$$I_{Ra1} = \frac{V_{H+} + V_{I01} - \left(V_{H+} + \frac{V_{I01} + V_{I02}}{2}\right)}{R_a} = \frac{V_{I01} - V_{I02}}{2R_a}$$

Here, the output current value $I_{Ra1}$ flowing through the operational amplifier 43 is required to be within the drive current range of the operational amplifier 43. For example, if the value $(V_{IO1}-V_{IO2})$ in the above equation is assumed to be 20 mV at maximum and $R_a$ is assumed to be 100Ω, $I_{Ra1}$ becomes 100 μA.

In this way, the value of the resistance $R_a$ is determined in accordance with the offset voltage in the operational amplifier 43. Naturally, as this resistance $R_a$ is smaller, an error from the desirable grayscale voltage $V_g$ becomes smaller. However, reversely, if it is too small, an unnecessary current caused by the offset voltage becomes large. That is, they have a trade-off relation. While they are considered, the resistance $R_a$ is preferably optimally designed.

As mentioned above, since the resistance $R_a$ is inserted into the output of the grayscale power supply operational amplifier 43, this has an effect of improving a phase margin for a capacitive load in the operational amplifier 43, in addition to the effect of preventing the abnormal current. This results from the improvement of the capacitance characteristic to the load, because the resistance is inserted outside the feedback loop of the operational amplifier 43.

Second Embodiment

The liquid crystal display apparatus according to the second embodiment of the present invention will be described below with reference to FIGS. 6 and 7. The liquid crystal display apparatus in the second embodiment is configured such that the LCD source driver 100A and the reference voltage generating circuit 400A in the first embodiment are replaced with an LCD source driver 100B and a reference voltage generating circuit 400B, respectively.

Figure 6:
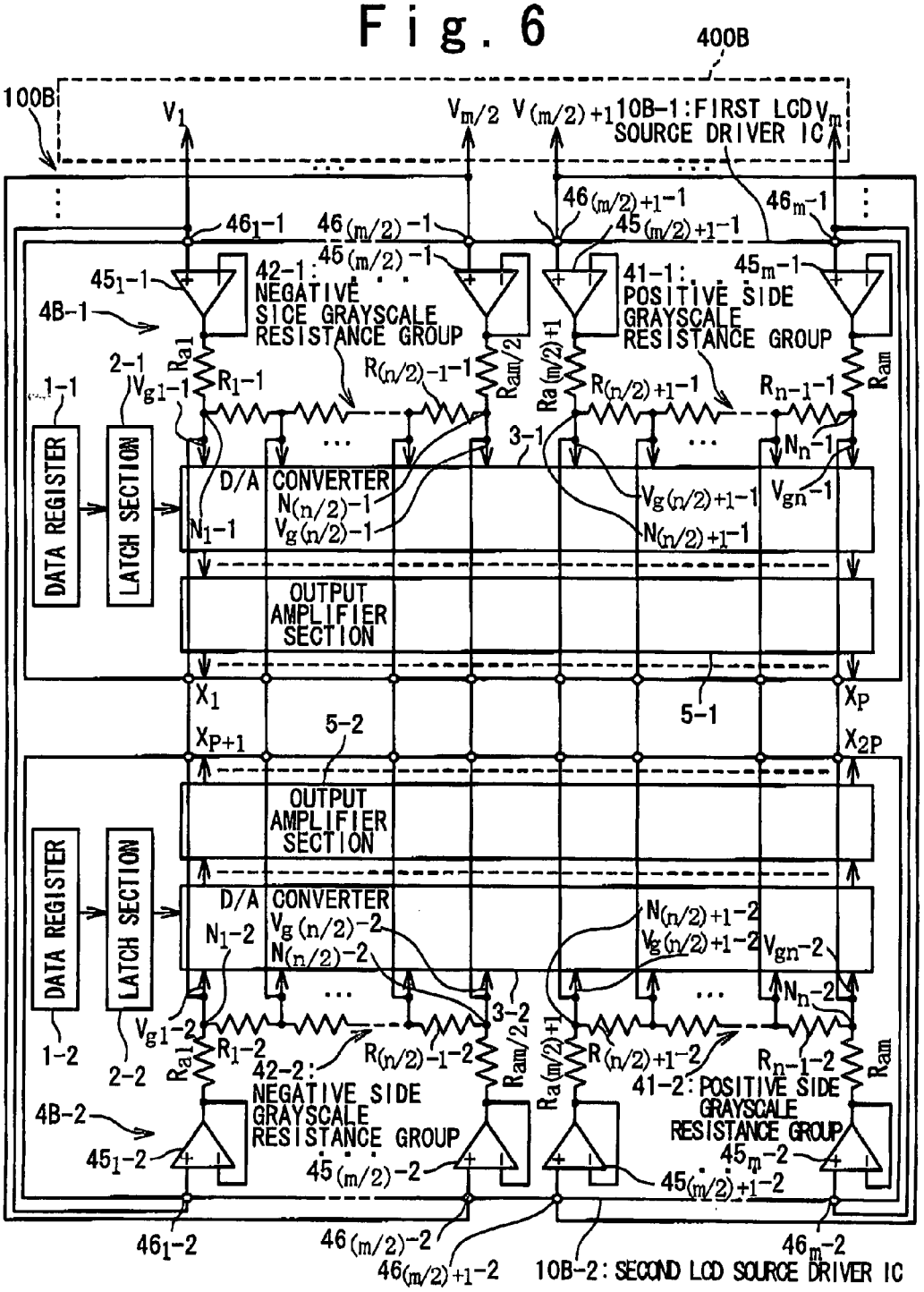
FIG. 6 is a block diagram showing a configuration of the LCD source driver according to a second embodiment of the present invention.
Figure 7:
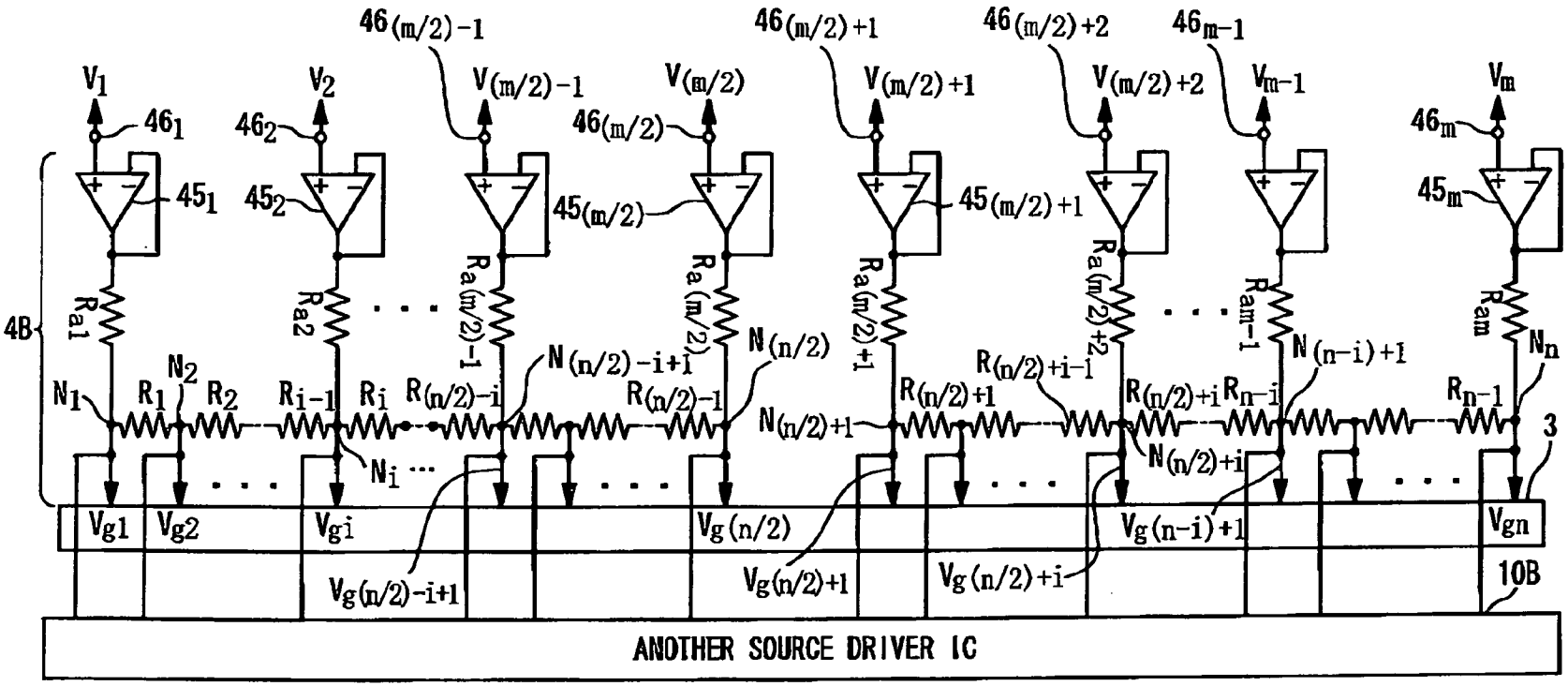
FIG. 7 is a block diagram showing a configuration of a grayscale voltage generating circuit according to the second embodiment of the present invention.

FIG. 6 is a block diagram showing the configuration of the LCD source driver 100B in the second embodiment. FIG. 7 is a block diagram showing the detailed configuration of a grayscale voltage generating circuit 4B in the second embodiment. With reference to FIG. 6, the LCD source driver 100B has a first LCD source driver IC 10B-1 and a second LCD source driver IC 10B-2. The LCD source driver IC 10B has the grayscale voltage generating circuit 4B, the data register 1, the latch section 2, the D/A converter 3 and the output amplifier section 5.

The grayscale voltage generating circuit 4B has the positive side grayscale resistance group 41, the negative side grayscale resistance group 42, operational amplifiers $\mathbf{45}_1$ to $\mathbf{45}_m$ that are the operational amplifiers forming the voltage followers, and resistances $R_{a1}$ to $R_{am}$. The grayscale voltage generating circuit 4B in the second embodiment has the m operational amplifiers $\mathbf{45}_1$ to $\mathbf{45}_m$ in which the number m of the operational amplifiers is equal to or less than the number n of the nodes $N_1$ to $N_n$ in the positive side grayscale resistance group 41 and negative side grayscale resistance group 42 of the first embodiment. As for the number of the operational amplifiers 45, typically, a 6-bit product has a total of 10 (m=10) operational amplifiers 45, which are composed of five on the positive side and five on the negative side. Or, an 8-bit product has a total of 18 (m=18) operational amplifiers 45, which are composed of nine on the positive side and nine on the negative side. Also, the output ends of the operational amplifiers $\mathbf{45}_1$ to $\mathbf{45}_m$ are connected through the resistances $R_{a1}$ to $R_{am}$ to any of the nodes $N_1$ to $N_n$. On the other hand, the reference voltage generating circuit 400B has m constant voltage sources $V_1$ to $V_m$. Non-inversion input terminals $\mathbf{46}_1$ to $\mathbf{46}_m$ of the operational amplifiers $\mathbf{45}_1$ to $\mathbf{45}_m$ are connected to the constant voltage sources $V_1$ to $V_m$. However, they are connected as mentioned above, between the resistance $R_a$, the operational amplifier 45, the non-inversion input terminal 46 and the constant voltage source V in which the same subscripts are assigned.

The negative side grayscale resistance group 42 and the positive side grayscale resistance group 41 are connected through the nodes $N_1$ to $N_n$ to the D/A converter 3. The respective nodes $N_1$ to $N_n$ supply the grayscale voltages $V_{g1}$ to $V_{gn}$, which are based on the voltages from the operational amplifiers $\mathbf{45}_1$ to $\mathbf{45}_n$ to the D/A converter 3. On the other hand, the nodes $N_1$-1 to $N_n$-1 in the first LCD source driver IC 10B-1 and the nodes $N_1$-2 to $N_n$-2 in the second LCD source driver IC 10B-2 are commonly connected. Thus, the grayscale voltages $V_{g1}$-1 to $V_{gn}$-1 in the first LCD source driver IC 10B-1 and the $V_{g1}$-2 to $V_{gn}$-2 in the second LCD source driver IC 10A-2 in which the subscript numbers correspond thereto have the same voltages, respectively.

As mentioned above, in the LCD source driver 100B according to the present embodiment, the non-inversion input terminal 46-1 of the operational amplifier 45-1 in the first LCD source driver IC 10B-1 and the non-inversion input terminal 46-2 of the operational amplifier 45-2 in the second LCD source driver IC 10B-2 are commonly connected to the corresponding power supply voltages $V_1$ to $V_m$ in the reference voltage generating circuit 400B. Also, between the two LCD source driver ICs 10B-1 and 10B-2, the nodes $N_1$-1 to $N_n$-1 that supply the grayscale voltages $V_{g1}$ to $V_{gn}$ are connected in parallel to the corresponding nodes $N_1$-2 to $N_n$-2. Moreover, the resistance $R_a$ for preventing the abnormal current from flowing due to the shorted state between the operational amplifiers 45-1 and 45-2 is provided between the node N connected to the output end of the operational amplifier 45 and the positive side grayscale resistance group 41 and the negative side grayscale resistance group 42.

The detailed configuration of the grayscale voltage generating circuit 4B according to the present invention will be described below with reference to FIG. 7. The output ends of the operational amplifiers 45 serving as the voltage follower are usually connected to the nodes N at a rate of one per several nodes. That is, the n grayscale voltages can be generated by the m reference power supplies. In detail, the output ends of the operational amplifiers $\mathbf{45}_1$ to $\mathbf{45}_{(m/2)}$ are connected to every several nodes N from one end (the node $N_1$) to the other end (the node $N_{(n/2)}$) in the negative side grayscale resistance group 42. Similarly, the output ends of the operational amplifiers $\mathbf{45}_{(m/2)+1}$ to $\mathbf{45}_m$ are connected to every several nodes N from one end (the node $N_{(n/2)+1}$) to the other end (the node $N_n$) in the positive side grayscale resistance group 41. For example, the operational amplifier $\mathbf{45}_1$ and the operational amplifier $\mathbf{45}_2$ can supply the grayscale voltages $V_{g1}$ to $V_{gi}$ including the middle grayscale from the nodes $N_1$ to Ni. Also, all of the nodes $N_1$ to $N_n$ are connected to the nodes $N_1$ to $N_n$ to which the other LCD source driver ICs 10B correspond. Moreover, as mentioned above, the resistance $R_a$ is provided between the operational amplifier 45 and the node N connected to the operational amplifier 45.

(Operation of Lcd Source Driver 100B)

The operation of the LCD source driver 100B in the second embodiment is basically same as the first embodiment. Thus, the detailed description thereof is omitted. In the second embodiment, similarly to the first embodiment, the output ends of the operational amplifiers 45 of the different LCD source driver ICs 10B are connected through the resistance $R_a$ to each other. Thus, it is possible to prevent the abnormal current from being generated between the operational amplifiers 45-1 to 45-2. Thus, even in the configuration that has the m operational amplifiers 45 for determining the grayscale signal $V_g$ of the middle grayscale level, the outputs of the operational amplifiers 45 between the plurality of LCD source driver ICs 10B can be connected to each other. Moreover, the grayscale characteristic can be freely determined in the LCD source driver 100B based on the reference voltages $V_1$ to $V_m$ that can be externally set. Also, as described in the first embodiment, the offset voltages of the respective grayscale power supply operational amplifiers 45 in the first and second LCD source driver ICs 10B-1, 10B-2 are averaged, thereby determining the displaying grayscale at the common grayscale voltage. Therefore, even if the LCD source driver IC 10B drives the data line X in response to the grayscale voltage based on the same reference supply power supply, the block unevenness is never generated on the LCD panel 300.

Third Embodiment

The liquid crystal display according to the third embodiment of the present invention will be described below with reference to FIG. 8. The liquid crystal display in the third embodiment is configured such that the LCD source driver 100A in the first embodiment is replaced with the LCD source driver 100C.

Figure 8:
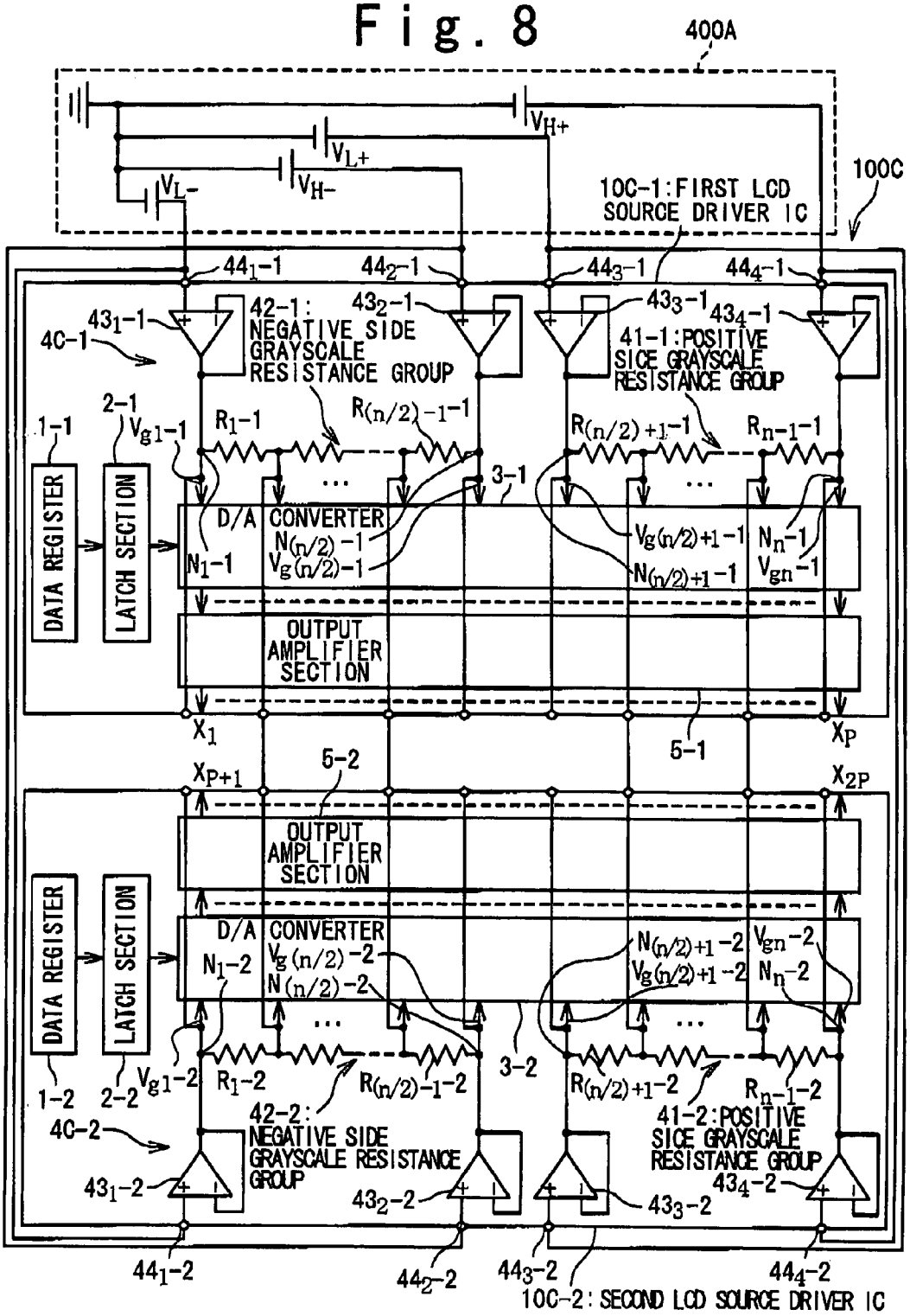
FIG. 8 is a block diagram showing a configuration of the LCD source driver according to a third embodiment of the present invention.

FIG. 8 is a block diagram showing the configuration of the LCD source driver 100C in the third embodiment. With reference to FIG. 8, the LCD source driver 100C has a first LCD source driver IC 10C-1 and a second LCD source driver IC 10C-2. The LCD source driver IC 10C has a grayscale voltage generating circuit 4C, the data resistance 1, the latch circuit 2, the D/A converter 3 and the output amplifier section 5.

The grayscale voltage generating circuit 4C is configured such that the resistances $R_{a1}$ to $R_{a4}$ in the grayscale voltage generating circuit 4A in the first embodiment are set to 0Ω and only the connections between the node $N_1$-1 and the node $N_1$-2, between the node $N_{(n/2)}$-1 and the node $N_{(n/2)}$-2, between the node $N_{(n/2)+1}$-1 and the node $N_{(n/2)+1}$-2 and between the node $N_n$-1 and the node $N_n$-2 are opened. The third embodiment is effective in case that the resistances cannot be provided at the output end of the operational amplifier 43. In this case, in order to prevent the abnormal current from flowing due to the shorted state between the outputs of the operational amplifiers 43, the connection between the nodes N in which in the first embodiment, the operational amplifiers 43 are connected to the output ends of the operational amplifiers 43 of the other LCD source drivers without any intervention of the resistance are opened, and the other nodes are commonly connected.

(Operation of LCD Source Driver 100C)

The operation of the LCD source driver 100C in the third embodiment is basically the same as that of the first embodiment. Thus, the detailed description will be omitted. In the third embodiment, the LCD source driver IC 10C-1 and the LCD source driver IC 10C-2 are opened between the nodes N that supply the highest voltage $Vg_{(n/2)}$) or $V_{gn}$ and the lowest voltage $V_{g1}$ or $Vg_{(n/2)+1}$ in the grayscale voltage $V_g$. The highest voltage $V_{g(n/2)}$ or $V_{gn}$ and the lowest voltage $V_{g1}$ or $V_{g(n/2)+1}$ in the grayscale voltage are the grayscale voltages to drive the data lines X close the white and black displaying, with regard to the operation of the LCD module. This grayscale is low in sensibility, and a slight voltage error between the LCD source drivers 10C is not recognized as a grayscale error. Thus, this is hard to recognize as the block unevenness.

As mentioned above, according to the LCD source driver 100 based on the present invention, even if the grayscale power supply operational amplifiers built in the plurality of LCD source driver ICs 10 have the different offset voltages, the display block unevenness is never generated in the LCD panel 300. Also, the effect of improving the phase margin for the capacitive load in the operational amplifier 43 can be expected.

Although the embodiments of the present invention have been detailed as mentioned above, the specific configuration is not limited to the above-mentioned embodiments. Even the change belonging to the range without departing from the scope and spirit of the present invention is included in the present invention.

What is claimed is:

1. A liquid crystal display (LCD) data driver integrated circuit, comprising:

a grayscale voltage generating circuit configured to generate a plurality of grayscale voltages from a set of supply reference voltages;

a plurality of connection terminals corresponding in number to said plurality of grayscale voltages; and a converting section connected to said connection terminals and configured to drive each of a plurality of data lines of a liquid crystal display panel through one of said connection terminals based on one of said plurality of grayscale voltages which is determined based on an input data, when each of a plurality of scanning lines of the liquid crystal display panel is driven, wherein said grayscale voltage generating circuit comprises:

a resistance circuit having resistances connected in series; and a plurality of voltage buffers connected to said resistance circuit to bias said resistance circuit, and wherein, when said LCD data driver integrated circuit comprises a first LCD data driver integrated circuit used in an LCD apparatus to drive a first portion of the display of the LCD apparatus and a second LCD data driver integrated circuit, similar to said first LCD data driver integrated circuit, is used to drive a second portion of the display, non-inversion input terminals of said plurality of voltage buffers in said first LCD data driver integrated circuit are connected in common to non-inversion terminals of corresponding ones of said plurality of voltage buffers in said second LCD data driver integrated circuit, and at least a portion of said connection terminals in said first LCD data driver integrated circuit and a corresponding portion of said connection terminals in said second LCD data driver integrated circuit are connected to each other.

2. The LCD data driver integrated circuit according to claim 1, wherein said plurality of voltage buffers comprises two voltage buffers connected to ends of said resistance circuit.

3. The LCD data driver integrated circuit according to claim 2, wherein said grayscale voltage generating circuit further comprises:

a protection resistance connected between said resistance circuit and an output of each of said two voltage buffers.

4. The LCD data driver integrated circuit according to claim 3, wherein all of said connection terminals in one of said two LCD data driver integrated circuits and all of said connection terminals in the other of said two LCD data driver integrated circuits can be respectively interconnected to each other such that a connection terminal in one LCD data driver integrated circuit will connect to a corresponding connection terminal in the other LCD data driver integrated circuit.

5. The LCD data driver integrated circuit according to claim 2, wherein all of said connection terminals other than said connection terminal corresponding to said ends in one of said two LCD data driver integrated circuits and all of said connection terminals other than said connection terminal corresponding to said ends in the other of said two LCD data driver integrated circuits can be respectively interconnected to each other such that a connection terminal in one LCD data driver integrated circuit will connect to a corresponding connection terminal in the other LCD data driver integrated circuit.

6. The LCD data driver integrated circuit according to claim 1, wherein said grayscale voltage generating circuit comprises said plurality of voltage buffers connected to nodes between said resistances of said resistance circuit to bias said resistance circuit, and said reference voltage generating circuit generates the set of supply reference voltages for said plurality of voltage buffers.

7. An liquid crystal display (LCD) apparatus, comprising:

an LCD panel having a plurality of data lines and a plurality of scanning lines, wherein pixels are provided at intersections of said plurality of data lines and said plurality of scanning lines;

a reference voltage generating circuit configured to generate a set of supply reference voltages; and two driver integrated circuits connected to each other through said plurality of data lines, wherein each of said plurality of driver integrated circuits comprises:

a grayscale voltage generating circuit configured to generate a plurality of grayscale voltages from the set of supply reference voltages; and a converting section connected to a plurality of connection terminals and configured to drive each of said plurality of data lines through one of said connection terminals based on one of said plurality of grayscale voltages which is determined based on an input data, when each of said plurality of scanning lines is driven, a number of said plurality of connection terminals corresponding to a number of said plurality of grayscale voltages, said grayscale voltage generating circuit comprising:

a resistance circuit having resistances connected in series; and a plurality of voltage buffers connected to said resistance circuit to bias said resistance circuit, non-inversion input terminals of pairs of one of said plurality of voltage buffers in one of said two driver integrated circuits and corresponding one of said plurality of voltage buffers in the other of said two driver integrated circuits are connected in common to said reference voltage generating circuit, and at least a portion of said connection terminals in one of said two driver integrated circuits and a corresponding portion of said connection terminals in the other of said two driver integrated circuits are connected to each other.

8. The LCD apparatus according to claim 7, wherein said plurality of voltage buffers comprises two voltage buffers connected to ends of said resistance circuit.

9. The LCD apparatus according to claim 8, wherein said grayscale voltage generating circuit further comprises:

a protection resistance connected between said resistance circuit and an output of each of said two voltage buffers.

10. The LCD apparatus according to claim 9, wherein all of said connection terminals in one of said two driver integrated circuits and all of said connection terminals in the other of said two driver integrated circuits are respectively interconnected to each other such that a connection terminal in one LCD driver integrated circuit connects to a corresponding connection terminal in the other LCD driver integrated circuit.

11. The LCD apparatus according to claim 8, wherein all of said connection terminals other than said connection terminal corresponding to said ends in one of said two driver integrated circuits and all of said connection terminals other than said connection terminal corresponding to said ends in the other of said two driver integrated circuits are respectively interconnected to each other such that a connection terminal in one LCD driver integrated circuit connects to a corresponding connection terminal in the other LCD driver integrated circuit.

12. The LCD apparatus according to claim 7, wherein said grayscale voltage generating circuit comprises said plurality of voltage buffers connected to nodes between said resistances of said resistance circuit to bias said resistance circuit, and said reference voltage generating circuit generates the set of supply reference voltages for said plurality of voltage buffers.

13. A method of displaying data in a liquid crystal display (LCD) apparatus which comprises an LCD panel having a plurality of data lines and a plurality of scanning lines, wherein pixels are provided at intersections of said plurality of data lines and said plurality of scanning lines, said method comprising:

generating a set of supply reference voltages;

generating a plurality of grayscale voltages from the set of supply reference voltages;

driving each of said plurality of data lines for a first portion of the LCD panel through one of connection terminals of a first LCD driver integrated circuit based on one of said plurality of grayscale voltages which is determined based on an input data, when each of said plurality of scanning lines is driven in said first portion of the LCD panel;

driving each of said plurality of data lines for a second portion of the LCD panel through one of connection terminals of a second LCD driver integrated circuit, when each of said plurality of scanning lines is driven in the second portion of the LCD panel; and connecting at least a portion of said connection terminals in said first LCD driver integrated circuit and a corresponding portion of said connection terminals of said second LCD driver integrated circuit to each other.

14. The method according to claim 13, wherein non-inversion input terminals of pairs of one of a plurality of voltage buffers in said first LCD driver integrated circuit and corresponding one of said plurality of voltage buffers in said second LCD driver integrated circuit are connected in common to the set of supply reference voltages.

15. The method according to claim 14, wherein said generating a plurality of grayscale voltages comprises:

connecting a protection resistance between said resistance circuit and an output of each of two voltage buffers as said plurality of voltage buffers, and said driving comprises:

respectively interconnecting all of said connection terminals in one of said two driver integrated circuits and all of said connection terminals in the other of said two driver integrated circuits to each other such that a connection terminal in one LCD driver integrated circuit connects to a corresponding connection terminal in the other LCD driver integrated circuit.

16. The method according to claim 14, wherein all of said connection terminals other than said connection terminal corresponding to said ends in one of said two driver integrated circuits and all of said connection terminals other than said connection terminal corresponding to said ends in the other of said two driver integrated circuits are respectively interconnected to each other such that a connection terminal in one LCD driver integrated circuit connects to a corresponding connection terminal in the other LCD driver integrated circuit.

17. The LCD data driver integrated circuit according to claim 1, wherein said plurality of connection terminals comprises nodes of said converting section that serve as input nodes of said converting section for receiving said plurality of grayscale voltages into said converting section, said plurality of connection terminals thereby respectively interconnecting said grayscale voltages between said two LCD data driver integrated circuits at the input nodes of the converting section of each said two LCD data driver integrated circuits.

18. The LCD data driver integrated circuit according to claim 17, wherein said respective interconnecting of said grayscale voltages at said input node of said converting section of said two LCD data driver integrated circuits thereby reduces any difference between respective grayscale voltages in said two LCD data driver integrated circuits.

19. The LCD apparatus of claim 7, wherein said plurality of connection nodes comprise nodes of said converting section that serve to receive said plurality of grayscale voltages into said converting section, said plurality of connection nodes thereby permitting said grayscale voltages to be respectively interconnected between said two LCD driver integrated circuits at the input nodes of the converting section of each said two LCD driver integrated circuits, thereby reducing any difference between respective grayscale voltages in said two LCD driver integrated circuits.

20. The method of claim 14, wherein said plurality of connection terminals comprises nodes of said converting section that serve to receive said plurality of grayscale voltages into said converting section, said plurality of connection nodes thereby permitting said grayscale voltages to be respectively interconnected between said two LCD driver integrated circuits at the input nodes of the converting section of each said two LCD driver integrated circuits, thereby reducing any difference between respective grayscale voltages in said two LCD driver integrated circuits.

* * * * *